United States Patent [19]

Nishida et al.

[11] Patent Number: 4,678,442

[45] Date of Patent: Jul. 7, 1987

[54] APPARATUS RESPONSIVE TO SHORTAGE OF COOLANT IN AN ENGINE OF A BOAT

[75] Inventors: Hiroshi Nishida, Miki; Mitsuhiro Yazaki, Kakogawa, both of Japan

[73] Assignee: Kawasaki Jukogyo Kabushiki Kaisha, Kobe, Japan

[21] Appl. No.: 752,151

[22] Filed: Jul. 3, 1985

[30] Foreign Application Priority Data

Jul. 5, 1984 [JP] Japan ..... 59-101836[U]

[51] Int. Cl.[4] ..... B63H 21/32

[52] U.S. Cl. ..... 440/89; 440/88; 60/277; 123/41.15

[58] Field of Search ..... 440/88, 89; 60/277, 60/278, 285, 310, 316, 317, 320, 321; 123/41.15, 198 D

[56] References Cited

U.S. PATENT DOCUMENTS

| | | | |
|---|---|---|---|
| 3,545,421 | 12/1970 | Strader | 60/277 |
| 3,762,163 | 10/1973 | Johns | 60/277 |
| 3,790,350 | 2/1974 | Haensel | 60/277 |
| 3,829,294 | 8/1984 | Smith | 60/277 |
| 4,194,460 | 3/1980 | Sato | 440/89 |
| 4,413,675 | 11/1983 | Gano | 123/41.25 |
| 4,484,548 | 11/1984 | Sugasawa | 60/277 |
| 4,504,238 | 3/1985 | Weisen | 440/89 |

*Primary Examiner*—Joseph F. Peters, Jr.
*Assistant Examiner*—C. T. Bartz
*Attorney, Agent, or Firm*—Marshall, O'Toole, Gerstein, Murray & Bicknell

[57] ABSTRACT

This disclosure relates to a water craft or boat including an engine room for an engine. The room is closed except for an opening through which intake air moves into the room, whereby the engine is supplied with intake combustion air. An exhaust line also extends between the engine and the outside of the room. Cooling means is provided in the room to collect coolant discharged from the engine and to inject it into the exhaust line in the room, whereby the coolant is discharged out of the room together with exhaust gas from the engine. Fuse means is provided in the exhaust line in the room downstream from the location where the coolant is injected. The fuse means is heat fusible to thereby form an opening when the gas in the exhaust line exceeds a predetermined temperature, whereby exhaust gas enters the room through the opening. The exhaust gas is drawn into the engine intake, causing the engine to fail to operate or to falter.

3 Claims, 4 Drawing Figures

APPARATUS RESPONSIVE TO SHORTAGE OF COOLANT IN AN ENGINE OF A BOAT

FIELD AND BACKGROUND OF THE INVENTION

The present invention relates to a water craft including a water-cooled engine and apparatus responsive to a shortage of coolant for the engine.

Relatively small water craft of the water jet type have become very popular. Such a craft includes a hull that forms an engine room, and an internal combustion engine mounted in the room. Generally in a conventional boat of such type, the cooling water leaving the engine is injected into the engine exhaust line and is discharged with the exhaust gas from the hull. If the coolant carrying pipe were to come out of joint or become clogged, there would be a resultant shortage of coolant, and the engine would become overheated.

Such a shortage of coolant has in the past been detected visually by the operator who may, for example, watch the flow of coolant through a bypass of the coolant pipe, or in a similar manner. This method is unsatisfactory because the operator may be distracted and not notice a shortage of coolant.

It is a general object of this invention to provide a simple and automatic apparatus for quickly responding to a shortage of coolant for the engine, and making the engine fail to operate and thereby prevent engine overheating.

BRIEF SUMMARY OF THE INVENTION

A water craft or boat according to the invention includes an engine room for an engine. The room is closed except for an opening through which intake air moves into the room, whereby the engine is supplied with intake combustion air. An exhaust line also extends between the engine and the outside of the room. Cooling means is provided in the room to collect coolant discharged from the engine and to inject it into the exhaust line in the room, whereby the coolant is discharged out of the room together with exhaust gas from the engine. Fuse means is provided in the exhaust line in the room downstream from the location where the coolant is injected. The fuse means is heat fusible to thereby form an opening when the gas in the exhaust line exceeds a predetermined temperature, whereby exhaust gas enters the room through the opening. The exhaust gas is drawn into the engine intake, causing the engine to fail to operate or to falter.

BRIEF DESCRIPTION OF THE DRAWINGS

Preferred embodiments of the invention are described below with reference to the accompanying figures of the drawings, wherein.

DETAILED DESCRIPTION OF THE DRAWINGS

Figure 1:
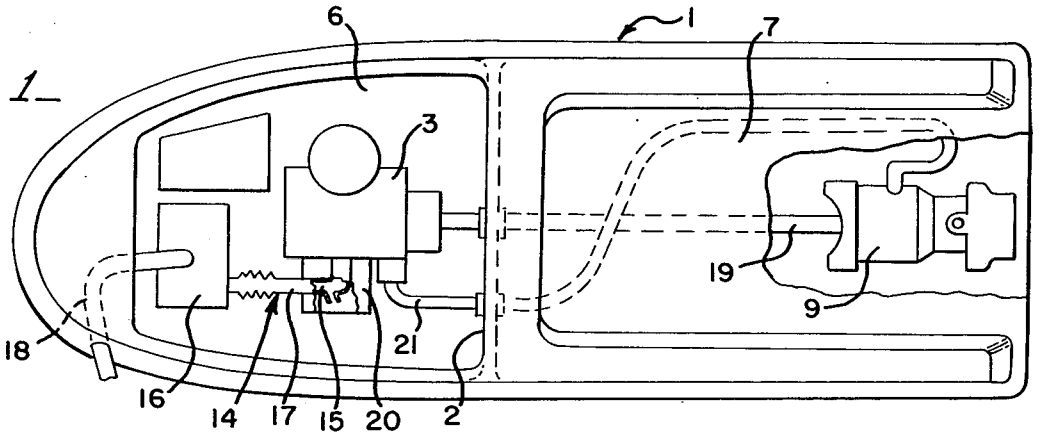
FIG. 1 is a schematic top plan view of a small boat embodying the invention, with parts removed to show interior parts.
Figure 2:
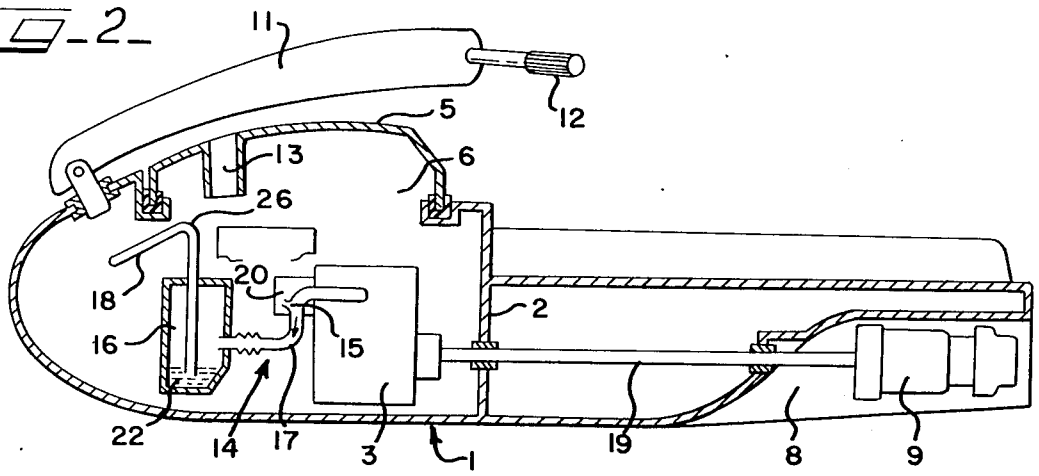
FIG. 2 is a schematic side view in longitudinal cross section of the boat shown in FIG. 1.

With reference to FIGS. 1 and 2, the boat includes a hull 1 divided into fore and aft sections by a laterally extending bulkhead 2. A boom 11 is pivotably mounted on the upper surface of the hull in the fore section, and terminates in steering handles 12. The aft section has an axial-flow pump 9, which is driven by a drive shaft 19 to produce a water jet for propulsion of the boat.

The fore section of the hull forms an engine room that has a top opening which is normally closed by an engine room hood 5, thereby forming the engine room 6. The room 6 houses an internal combustion engine 3 which is coupled to the drive shaft 19 and has a conventional water jacket 20 provided thereon for cooling the engine.

The room 6 has an air intake duct 13 (FIG. 2) which extends through an opening in the hood 5 and into the room 6. The duct 13 forms a passage having an area which should be as small as practicable, to keep water out of the engine room. The duct 13 may be replaced by a hole in the hood 5, which would function also as a venthole.

The room 6 also has an exhaust system 14 which includes pipes 17 and 18. The pipe 17 extends between the exhaust port of the engine 3 and a water box 16, which forms a muffler. The box 16 has a water well 22 (FIG. 2) formed in the bottom section thereof. This pipe 17 has in an intermediate portion a cooling water injection port 15 relatively close to the engine. The other pipe 18 extends from the water box 16 and out of the hull 1 through an opening formed in a side wall of the hull.

As shown in FIG. 1, a coolant line 21 extends from the jet pump 9, through the bulkhead 2 to the water jacket 20, which is thereby supplied with a diverted part of the water discharged from the pump 9, to cool the engine 3. The water leaving the jacket 20 is injected into the exhaust pipe 17 through the water injection port 15, and discharged together with the engine exhaust gas through the exhaust system 14 out of the hull 1. The exhaust gas in the pipe 17 can thus be cooled by the injected water to the order of 80° C., whereas the gas could be as hot as 300° C. without the injected cooling water.

The water box 16 is coupled at a side wall thereof to the exhaust pipe 17 by a resilient joint hose 23 (FIG. 3) made of rubber or plastic, gaskets 24, and a coupling 25 secured to the box 16. Fixedly secured in a hole in the top wall of the box 16 is the exhaust pipe 18 which extends downwardly in the box 16 to a location where the lower end of the pipe 18 opens at or adjacent a water well 22 formed by the space adjacent the bottom of the box 16. As shown in FIG. 2, above the box 16 the upper end portion of the pipe 18 curves downwardly and forms an inverted U-shape 26, and the pipe extends out of the hull. The shape 26 prevents water from the outside of the hull from flowing backward through the pipe and entering the exhaust system 14.

The water injected into the exhaust pipe 17 by the injection port 15 collects in the well 22 as shown in FIG. 2. If the water level becomes excessive and rises above the lower end of the exhaust pipe 18 in the box 16, the excessive amount of water is forced by the pressure of the exhaust gas from the engine 3 into the pipe 18 and discharged out of the hull 1. As a result, the water level in the well 22 remains substantially constant.

Figure 3:
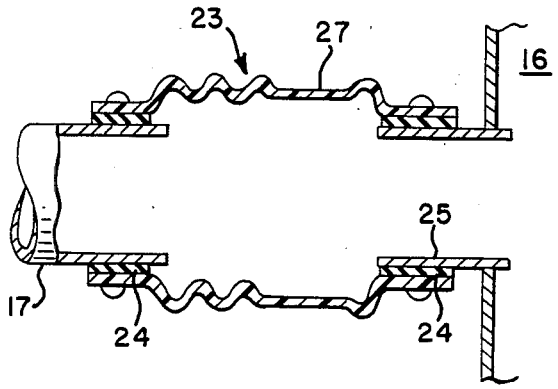
FIG. 3 is an enlarged fragmentary sectional view showing fuse means of the boat.

In the embodiment of the invention shown in FIG. 3, at least a portion of the joint hose 23 is formed with a thin wall portion 27, which fuses or ruptures quickly above a predetermined temperature. Instead of only a portion of the wall being thin, the entire hose 23 may have a thin wall.

If the coolant pipe 21 becomes disconnected or clogged causing a resultant shortage of cooling water for the engine, there is also little water injected through the port 15 into the exhaust pipe 17 as well. This lack of cooling water quickly raises the temperature of the exhaust gas in the system 14, and the gas is sufficiently hot that the thin wall 27 fuses and opens the exhaust system into the engine room 6. Then, most of the exhaust gas flows from the pipe 17 into the engine room 6 and fills the room, because the room 6 has a negative pressure during engine operation due to the engine breathing, and the exhaust line 14 has a passage resistance after the connector 25 because of the box 16 and the well 22. As a result, the engine 3 simultaneously sucks some fresh air from the duct 13 and some exhaust gas flowing through the fused wall 27. The resultant shortage of oxygen lowers the output of the engine 3, which will then falter or stop entirely. The lowered power output of the engine lowers the thermal load of the engine, thereby automatically preventing its seizure.

Figure 4:
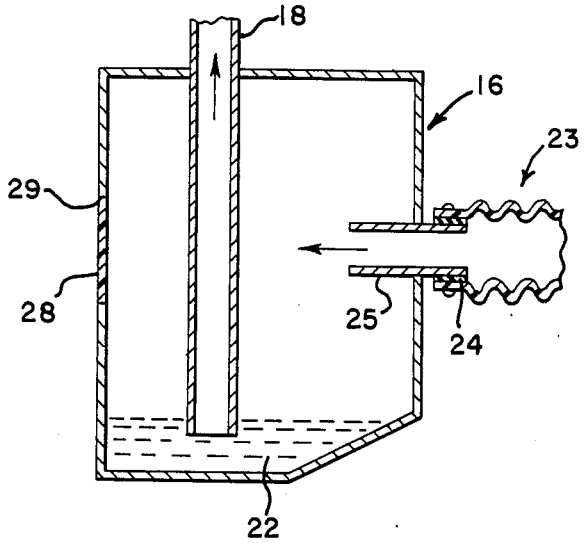
FIG. 4 is an enlarged fragmentary sectional view showing a modification of the fuse means.

In the embodiment of the invention shown in FIG. 4, the water box 16 has an opening 29 formed in a side wall thereof opposite the wall with the connector 25, and a fuse wall 28 is fastened in the opening 29. The wall 28 is in line with the gas leaving the connector 25 so that the gas from the exhaust system strikes the fuse wall 28. When the gas temperature becomes excessive, the wall 28 fuses or ruptures, and the gas flows into the engine room as previously described. As is also true of the hose 23, the broken fuse wall 28 may be easily replaced. Instead of only the wall 28, the entire box 16 may be formed of a fusible material, such as rubber, plastic or solder.

The present invention may likewise be applied to a motorboat or other water-borne vehicle propelled by a screw propeller, and also, of course, to a boat where the engine room is in the aft section of the hull.

What is claimed is:

1. In a boat including a hull forming an engine room, an internal combustion engine in said room, said room being substantially closed except for an air opening through which engine intake air flows into said room, whereby said engine is supplied with air from the room during operation, an exhaust system connected to said engine and extending to outside of said room, said engine including coolant flow means, cooling means in said room connected to said coolant flow means to receive coolant discharged from said engine and connected to inject said coolant into said exhaust system in said room, whereby the coolant is normally discharged during engine operation out of said room together with the exhaust gas from said engine, and fuse means provided in said exhaust system in said room downstream from the location where the coolant is injected, said fuse means being fusible to form an opening when the exhaust gas in said exhaust line exceeds a predetermined temperature, whereby exhaust gas enters said room through said opening and mixes with intake air entering the engine.

2. A boat according to claim 1, wherein said exhaust system includes a hose, and said fuse means comprises a thin wall of said hose.

3. A boat according to claim 1, wherein said exhaust system includes a water box, and said fuse means comprises a fusible wall of said water box connected in said exhaust line.

* * * * *